US005865368A

United States Patent [19]

Taylor et al.

[11] Patent Number: 5,865,368

[45] Date of Patent: Feb. 2, 1999

[54] MAIL DELIVERED INDICATOR APPARATUS AND METHOD

[76] Inventors: Frank R. Taylor; Laura F. Taylor, both of 23638 War Eagle Blacktop Rd., Springdale, Ark. 72764

[21] Appl. No.: 656,862

[22] Filed: May 30, 1996

[51] Int. Cl.[6] ..... B65D 91/00

[52] U.S. Cl. ..... 232/35

[58] Field of Search ..... 232/17, 34, 35, 232/37

[56] References Cited

U.S. PATENT DOCUMENTS

| | | | |
|---|---|---|---|
| 2,433,940 | 1/1948 | Weaver . | |
| 2,693,314 | 11/1954 | Hunter | 232/35 |
| 2,730,298 | 1/1956 | Haserodt | 232/35 |
| 3,343,784 | 9/1967 | Waldhaus et al. | 232/35 |
| 3,596,631 | 8/1971 | Sutton | 116/132 |
| 3,794,240 | 2/1974 | Myers | 232/35 |
| 3,968,928 | 7/1976 | Caldwell | 232/35 |
| 4,171,086 | 10/1979 | Hudson | 232/35 |
| 4,375,134 | 3/1983 | Sheetz | 40/591 |
| 4,473,182 | 9/1984 | Dion | 232/35 |
| 4,491,268 | 1/1985 | Faulkingham | 232/35 |
| 4,711,391 | 12/1987 | Roge et al. | 232/35 |
| 4,840,307 | 6/1989 | Hartman | 232/35 |
| 4,896,624 | 1/1990 | Carnwath | 116/303 |
| 4,953,783 | 9/1990 | Chambers | 232/35 |
| 4,986,467 | 1/1991 | Bibbee | 232/34 |
| 5,082,170 | 1/1992 | Goss | 232/35 |
| 5,094,386 | 3/1992 | Tabacco | 232/35 |
| 5,123,590 | 6/1992 | Teele | 232/35 |
| 5,366,148 | 11/1994 | Schreckengost | 232/35 |
| 5,427,311 | 6/1995 | Kachmar | 232/35 |

*Primary Examiner*—Jerry Redman
*Attorney, Agent, or Firm*—Head, Johnson & Kachigian

[57] ABSTRACT

A mail delivered indicator apparatus and method is provided which includes a toggle bolt wing, a 90 degree stop element, and a relatively thin, planar stem or mast including a design element. One side of the toggle bolt wing is attached to the upper surface of a mailbox. The stem is attached to the other side of the toggle bolt wing. The 90 degree stop element is received by or attached to the toggle bolt wing to stop the stem from further movement when it reaches a substantially vertical position. An offset stem or mast includes a slight offset to allow the toggle bolt wing to be attached to the center of the upper surface of the mailbox and at the same time ensure that the free end of the stem bypasses the door latch attached to the upper forward surface of the mailbox. In a particular example, a stem having an offset and a design element integral therewith is reversible in order to accommodate the location of a standard outgoing mail signal flag mounted on either the right or left hand side of the mailbox. In another embodiment of the invention, the design element or cutout is a separate item which is attached to an elongate stem or mast. The attachable design may have attachment holes which accommodate an offset stem. To accommodate not only an outgoing mail flag, but also a name and/or address plate located along the central upper ridge of the mailbox, an L-shaped mounting bracket and a hook-shaped catch are used to mount the toggle bolt wing and stem on either the right or left hand side of the mailbox.

20 Claims, 9 Drawing Sheets

MAIL DELIVERED INDICATOR APPARATUS AND METHOD

BACKGROUND OF THE INVENTION

1. Field of the Invention

The present invention is directed to an apparatus and method for indicating that a mailbox has been opened to receive mail, ornamental designs for such apparatus, attachable design elements, integral masts and design elements, spring biasing elements, stop elements, mounting brackets and the like, and more particularly concerns an apparatus and method employing an indicator which is spring biased to a raised substantially vertical position signaling the owner of a mailbox that mail has been delivered by the U.S. Postal Service, ornamental designs for such indicators, and the like.

Conventional mailboxes include a movable outgoing mail signal flag, typically red in color, mounted on the right or left side of the mailbox and raised to indicate the presence of mail in the mailbox to be picked up by a U.S. Post Office mailperson or mail carrier. Often, but not always, the person picking up the mail from the mailbox will lower the flag when the mail has been picked up. This indicates to the owner of the mailbox that the mail has been picked up but does not provide an indication of whether or not any mail has been delivered.

It is not uncommon in a rural setting for the mailbox to be located some distance away from the house or even on the opposite side of a road or highway from the house. It may be inconvenient such as in bad weather or if a great distance is involved, or even unsafe or dangerous for the mailbox owner to check for delivered mail when, in fact, no mail has been delivered to the mailbox. Thus, there has been a need for a signal or indicating device which alerts the mailbox owner not only to the fact that outgoing mail has been picked up by the U.S. Postal worker but also indicates whether or not incoming mail has been delivered into the mailbox.

2. Prior Art

U.S. Pat. Nos. 4,171,086, 4,953,783, and 5,427,311 disclose mailbox signal devices which operate under the force of gravity to either raise or lower the signal device and indicate that mail has been delivered by the U.S. Postal Service.

U.S. Pat. Nos. 2,433,940, 3,596,631, 4,711,391, 5,123,590, and 5,366,148 are directed to mailbox signal devices which are mounted to the side or upper surface of the mailbox and spring biased by a coil tension spring to an upper position to indicate that the mailbox has been opened and mail has been delivered by the U.S. Postal Service.

U.S. Pat. Nos. 4,491,268, 4,840,307, and 5,082,170 disclose mailbox signal devices mounted to the upper surface or side surface of a mailbox and which are biased to an upward signaling condition by a torsion spring.

Other mailbox signal devices are disclosed in U.S. Pat. Nos. 3,794,240, 3,968,928, 4,896,624, 4,986,467, and 5,094,386.

The above-described signal devices suffer from the drawbacks of being overly complicated, having numerous moving parts which are susceptible to failure, require the conventional mailbox to be substantially modified, are not aesthetically pleasing, are not personalized, may not contain a sufficiently sized signal element to provide a clear indication of mail having been delivered at a large distance from the mailbox, or may be unsafe.

Hence, there is a need for an improved mail delivered indicator apparatus and method which is relatively inexpensive, easily attached to a conventional mailbox, aesthetically pleasing, capable of being personalized, which is adapted for use with a mailbox having a conventional outgoing mail signal flag mounted on either the right or left hand side of the mailbox, and which is easily placed to accommodate a name or address plate mounted on the upper surface of the mailbox.

SUMMARY OF THE INVENTION

In accordance with the present invention, an improved mail delivered indicator apparatus and method is provided which addresses the drawbacks of the prior art devices and in one of its exemplary forms includes a toggle bolt wing, a 90 degree stop element, and a relatively thin, planar stem or mast including a design element.

In accordance with one embodiment of the present invention, one side of a toggle bolt wing is attached to the upper surface of a mailbox, a stem is attached to the other side of the toggle bolt wing, and a 90 degree stop element is received by or attached to the toggle bolt wing to stop the stem from further movement when it reaches a substantially vertical position.

In accordance with one example of the present invention, the 90 degree stop element is a short set screw which is threaded through the nut in the toggle bolt wing and extends sufficiently outwardly from the apex of the wing to stop the stem at its vertical position.

In accordance with another example of the present invention, the 90 degree stop element is an L-shaped bracket having one leg of the L placed between one side of the wing and the upper surface of the mailbox and the other leg of the L located adjacent the apex of the wing to prevent the other side of the wing from traveling through more than 90 degrees upon upward movement of the stem.

In accordance with yet another example of the present invention, the 90 degree stop element is an L-shaped bracket having one leg of the L attached to the outer surface of the side of the wing having the stem attached to the inner surface thereof and with the other leg of the L extending away from that side of the wing and contacting the upper surface of the mailbox when the stem reaches a substantially vertical position.

In accordance with another aspect of the present invention, the stem or mast includes a slight offset to allow the toggle bolt wing to be attached to the center of the upper surface of the mailbox and at the same time ensure that the free end of the stem bypasses the door latch attached to the upper forward surface of the mailbox.

In accordance with a particular example of the present invention, a stem having an offset and a design element integral therewith is reversible in order to accommodate the location of a standard outgoing mail signal flag mounted on either the right or left hand side of the mailbox and also to allow the stem offset to go to either the right or left hand side of the door latch.

In accordance with another embodiment of the present invention, the design element or cutout is a separate item which is attached to an elongate stem or mast. In accordance with a particular example, the elongate stem or mast has an offset near its midsection and the attachable design has attachment holes which accommodate this offset.

In accordance with another feature of the present invention, the design element may be a name plate or include a family name, address, business name, logo, team name, or the like. Thus, the design element may be personalized not only from the standpoint of selecting a particular design but also by including words, letters, characters and the like.

In accordance with still yet another embodiment, the present invention provides for the accommodation of not only an outgoing mail flag, but also a name and/or address plate located along the central upper ridge of the mailbox by utilizing an L-shaped mounting bracket and a hook-shaped catch to mount the toggle bolt wing and stem on either the right or left hand side of the mailbox.

The principal object of the present invention is the provision of an improved mail delivered indicator apparatus and method.

Another object of the present invention is the provision of an improved mail delivered indicator apparatus including a toggle bolt wing, a 90 degree stop element, a stem and a design.

A still further object of the present invention is the provision of a stem having a design integral therewith.

Yet another object of the present invention is the provision of a mounting bracket and catch for attaching the mail delivered indicator apparatus to the side of a mailbox.

A more particular object of the present invention is the provision of a stem having a slight offset to accommodate the door latch of a conventional mailbox.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENTS

Figure 1:
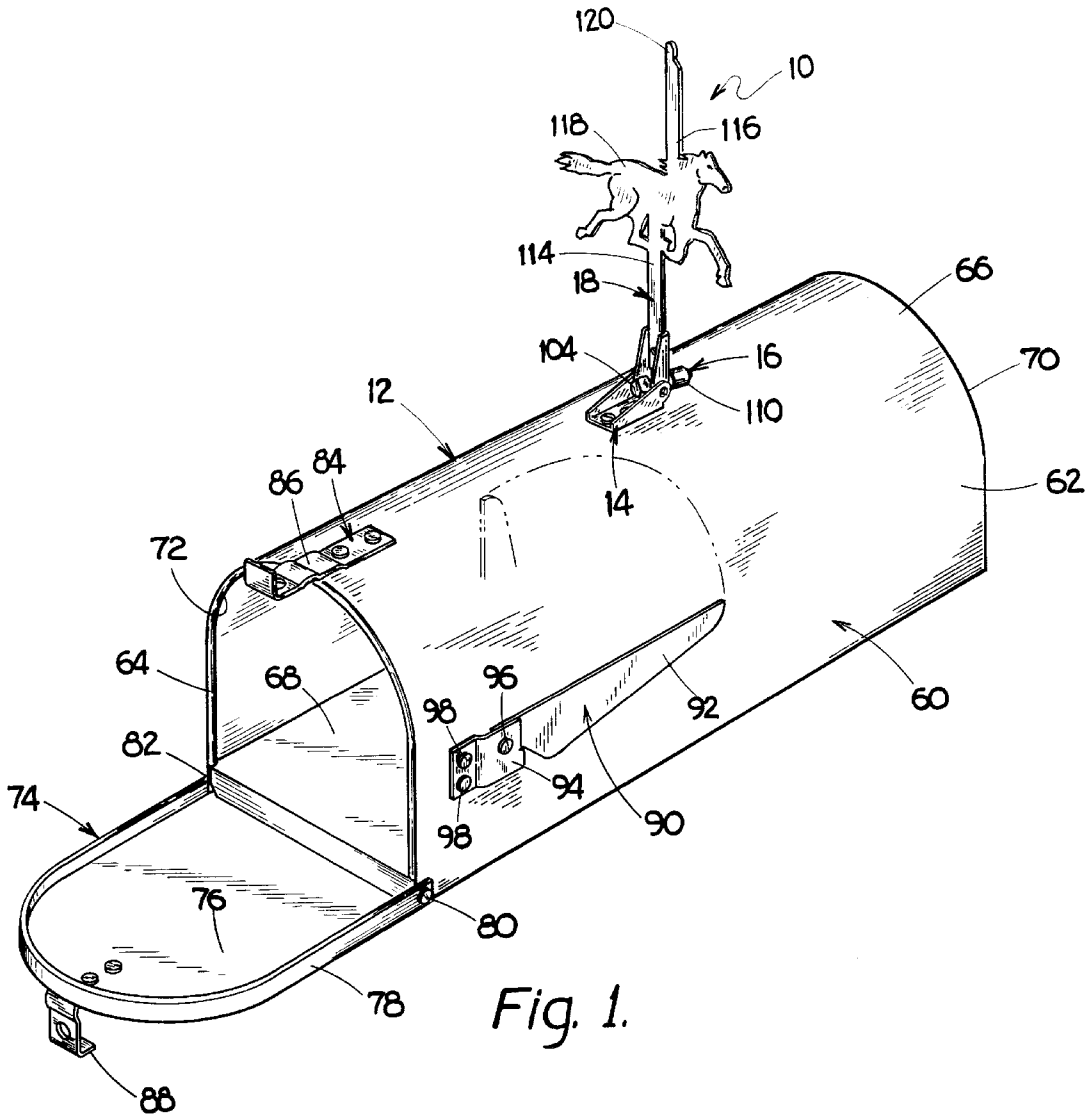
FIG. 1 is a perspective view illustration of a mail delivered indicator apparatus of the present invention attached to the upper surface of a conventional mailbox and with the stem and design element in a substantially vertical position following opening of the door to the mailbox.
Figure 3:
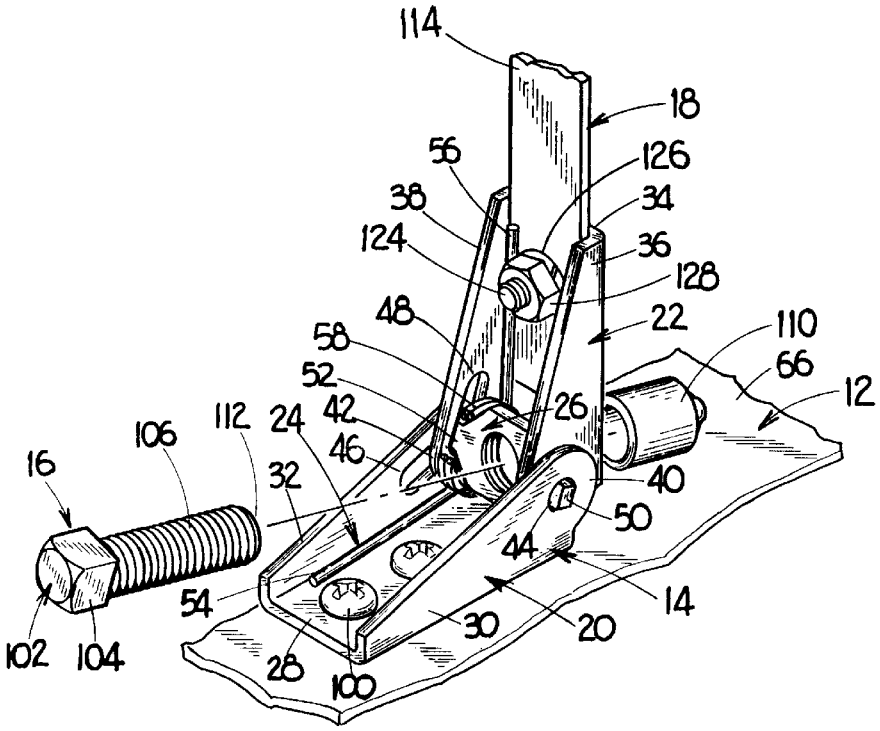
FIG. 3 is an enlarged perspective view illustration of the toggle bolt wing of the mail delivered indicator apparatus of FIG. 1 having the 90 degree stop element removed from the nut of the toggle bolt wing.
Figure 2:
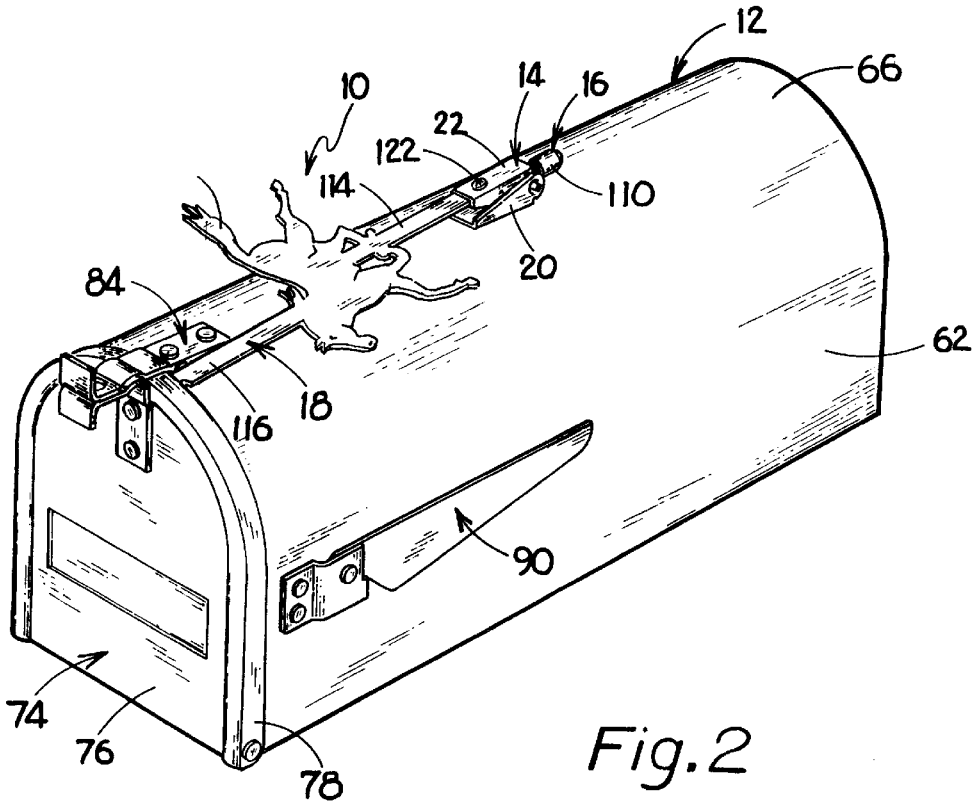
FIG. 2 is a perspective view representation of the mail delivered indicator apparatus and mailbox of FIG. 1 with the stem in its lowered position with the tip of the stem located under the edge of the mailbox door in its closed position.

In accordance with an exemplary embodiment of the present invention as shown in FIGS. 1–3 of the drawings, a mail delivered indicator, apparatus, device, or assembly, generally designated by the reference numeral 10 is attached to the upper surface of a conventional mailbox 12. The indicator apparatus 10 includes as major components a toggle bolt wing or hinge mechanism 14, a 90-degree stop element 16 and a stem or mast 18.

The toggle bolt wing 14 includes first and second side pieces 20 and 22, a helical torsion spring 24 and a nut 26. The first and second side pieces 20 and 22 are of similar construction except that the second side piece 22 is slightly narrower than the first side piece 20 so that it can fit within the side walls of the first side piece. Each of the side pieces 20 and 22 includes a respective base and side walls to form a U-shaped channel member 28, 30, 32 and 34, 36, 38. Each of the side walls 30, 32 and 36, 38 include a rounded end 40 and 42 and a circular or oval opening 44, 46 and 48. The circular and oval openings 44, 46 and 48 of each of the side walls 30, 32, 36 and 38 accommodate respective posts or stud 50 and 52 extending from the right and left sides of the nut 26. The posts 50 and 52 serve as pivot points for the side pieces 20 and 22.

Spring 24 includes first and second ends 54 and 56 and one or more helical coils 58. Post 52 passes through coils 58 and coils 58 are retained between nut 26 and side wall 38 of side piece 22. In this configuration, the spring 24 tends to force the toggle bolt wing to its open position shown in FIGS. 1 and 3 of the drawings. With hand pressure asserted against stem 18, the toggle bolt wing can be forced to the closed position against the force of spring 24 as shown in FIG. 2 of the drawings.

The mailbox 12 is of conventional design and includes a housing 60 having right and left vertical side walls 62 and 64 and a curved upper surface 66 connecting the side walls. The housing 60 further includes a base or bottom 68 a back wall 70 and a front opening 72. Hence, the housing 60 forms a chamber or cavity for receiving mail therein.

The mailbox 12 further includes a door 74 having a panel 76 with a rearwardly extending flange or lip 78 pivotally attached to the side walls 62 and 64 of housing 60 by pivots 80 and 82.

A mailbox door latch 84 has a female latch member 86 attached to the upper forward surface 66 of housing 60 and a male latch member 88 attached to the upper exterior surface of door panel 76.

The mailbox 12 further includes an outgoing mail signal or flag 90 including a flag member 92 pivotally attached to a bracket 94 by a pivot pin 96. Bracket 94 is attached to side wall 62 by fasteners 98. Although the outgoing mail signal 90 is shown attached to the right side of mailbox 12, it is to be understood that conventional mailboxes have the flag mounted on either the right or left side thereof and with the flag 92 extending above the upper surface 66 of the mailbox 12 when it is in its raised position shown in phantom line in FIG. 1 of the drawings.

Figure 14:
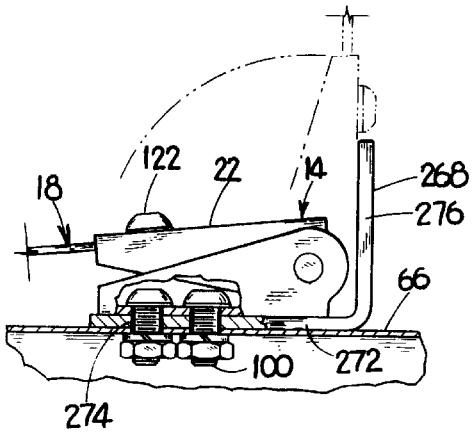
FIG. 14 is a partial cross-section side view illustration of an alternative 90 degree stop element in accordance with another embodiment of the present invention.

In accordance with the exemplary embodiment shown in FIGS. 1–3 of the drawings, the first side piece of toggle wing 14 is attached to the upper surface 66 of mailbox 12 by a pair of threaded fasteners 100 each having a threaded shaft which passes through a circular opening in base 28 of side piece 20 and corresponding circular openings in upper surface 66 of mailbox 12. A lock washer and nut are added to the threaded shaft extending within interior of mailbox housing 60 to complete the attachment of the toggle bolt wing 14 to the mailbox 12 (FIG. 14). In accordance with a preferred embodiment of the present invention, the toggle bolt wing 14 is attached along the center line of the upper surface 66 and the stem 18 includes an offset to accommodate the mailbox door latch 84.

The 90-degree stop element 16 shown in FIGS. 1–3 of the drawings, includes a set screw or bolt 102 having a head 104 and a threaded shaft 106. The threaded shaft 106 is adapted to be threadably received within a threaded opening 108 in nut 26. Also, the stop element 16 includes a protective plastic cap 110 adapted to be received over the end 112 of threaded shaft 106 extending through the nut 26. The protective cap 110 is formed of a plastic or rubber material which will prevent the scratching or other damage to upper surface 66 of mailbox 12 each time the indicator moves to its raised position (FIGS. 1–3).

With reference again to FIGS. 1–3 of the drawings, the stem or mast 18 includes a lower section 114, an upper section 116, and a design element 118 therebetween. The free end of upper section 116 necks down to form a reduced size tab 120 adapted to be received under the flange or lip 78 of mailbox door 74 (FIG. 2). The stem 18 is attached to second side 22 of toggle wing 14 by a threaded fastener 122 having a threaded shaft 124 receive through respective circular openings in the base 34 of side piece 22 and lower section 114 of stem 18. A lock washer and nut 126 and 128 are received on threaded shaft 124 and tightened against lower section 114 of stem 18 to complete the attachment.

In accordance with a particular example of the present invention, the stem 18 including the elongate lower and upper sections 114 and 116, the design element 118, and tab 120 is formed of a single piece of about 19–22 gauge steel laser cut to the shape shown in FIGS. 1–3. Also in accordance with this example, the overall length of the stem 18 is about 9 inches, the width of the upper and lower sections 114 and 116 is about ½ inch, the height of the circular opening for receiving threaded fastener 122 is about ¾ of an inch from the bottom of lower section 114 and the opening has a diameter large enough to receive a 8–32 ⅜ inch screw. Further in accordance with this example, the stem 18 is attached to a 5/16 inch zinc plated toggle bolt wing using a 8–32×⅜ inch screw, number 8 standard lock washer, and a number 8–32 steel hex nut. In this example, a standard 5/16 inch zinc plated toggle bolt wing has been modified by drilling one screw hole large enough to fit the 8–32×⅜ inch screw in the smaller toggle wing side piece for attaching the stem 18, and drilling two screw holes in the larger toggle wing side piece (bottom) each large enough to fit a 8–32×⅜ inch screw. Further, the modified toggle wing is attached to the top of the mailbox using two number 8–32×⅜ inch screws, two number 8 standard lock washers, and two number 8–32 hex nuts. Still further in accordance with this particular example of the present invention, the stop element 16 is made up of a 5/16 inch 18×1 square or round head set screw and a 5/16 inch screw protector or cap.

In accordance with a preferred embodiment of the present invention, the standard torsion spring of a 5/16 or 7/16 inch standard zinc plated toggle bolt wing is replaced with a torsion spring having a wire diameter of about 0.25–0.050 of an inch, preferably 0.033–0.038 of an inch, more preferably 0.035 of an inch with two helical coils wrapped around a stud extending from the nut of the toggle bolt wing. If desired, another spring can be added to the right side of the toggle bolt nut.

Figure 16:
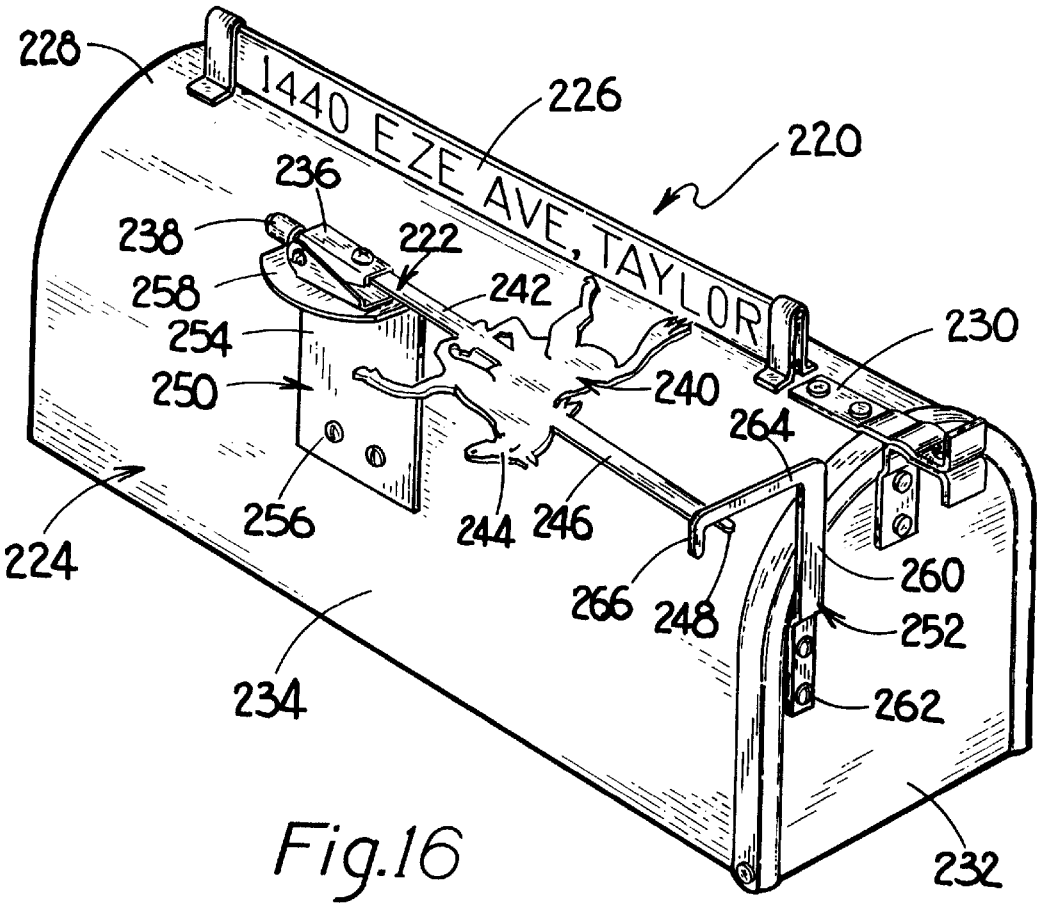

The stem or mast 18 having an integral design element 118 therein is preferably reversible to accommodate an outgoing mail signal or flag 90 located on either the right or left hand side of the mailbox 12. As shown in FIGS. 1 and 2 of the drawings, the stem 18 is oriented with the tail of the horse design element 118 directed leftwardly with respect to the mailbox. It is to be understood, however, that in order to accommodate an outgoing mail signal flag 90 located on the left hand side of a mailbox, the stem 18 is reversed by removing threaded fastener 122 rotating the stem through 180 degrees so that the tail of the design element is located rightwardly with respect to the mailbox and reattaching the stem to the side piece 22 with threaded fastener 122 (FIG. 16). With the stem 18 reversed from that shown in FIGS. 1 and 2, the upper stem section 116 would be received to the left hand side of latch 84. Although the delivered mail indicator shown in FIG. 16 of the drawings is mounted from the side of the mailbox, the stem of the indicator is identical to the stem 18 of FIGS. 1–3 of the drawings, except that the stem has been reversed so that the tail of the horse design element is directed rightwardly.

It is preferred to form the stem 18 of a relatively sturdy and yet flexible corrosion resistant material such as aluminum, painted or coated steel, stainless steel, plastic such as polyvinylchloride, and the like which can be cut, stamped, molded, or the like. Flexibility of at least the upper section 116 of stem 18 allows the tab 120 to be inserted under the lip 78 of mailbox door 74.

Although the stem 18 is shown as a separate item from toggle wing 14, it is contemplated that in accordance with one embodiment of the present invention the stem 18 and toggle side piece 22 may be formed as an integral item. For example, they may be a molded plastic or metal item. Along these same lines, it is contemplated that the stop element 16 and toggle wing nut 26 may be formed as a single molded or integral item.

Also, in accordance with the present invention, the aesthetically pleasing appearance of the device 10, stem 18, toggle wing 14, and/or stop element 16 may be enhanced by forming these items of a corrosion resistant material such as zinc, chrome, brass, or gold tone coated or plated materials. Also, the device 10 may be painted any color, for example, white, black, red, blue, or the like to provide a monochromic appearance to the mailbox, or different colors to suit the personal preference of the purchaser or user.

Although it is preferred to use a removable threaded fastener for attaching the stem 18 to the toggle bolt wing 14 and for attaching the toggle bolt wing 14 to the mailbox 12, it is envisioned that a non-releasable attachment by, for example, rivets, welding, arc welding, gluing, adhesive, or solvents or by use of one-way fasteners such as non-removable threaded fasteners or locknuts may prevent theft of the device 10 or its components from the mailbox 12.

Although it is preferred to use a toggle bolt wing 14 as the hinge mechanism for operatively mounting or attaching the stem 18 to the upper surface of mailbox 12, it is contemplated that other hinge mechanisms may be used. For example, if mailbox 12 is formed of a molded plastic material, the lower wing piece 20 may be formed integral with the upper surface 66 forming one hinge side piece while the cooperating hinge side piece and stop element is attached to or integral with the base of stem 18 and a pivotal connection provided therebetween by a pivot pin and a torsion spring. Still further, it is envisioned that the lower section 114 of stem 118 may be elongated and attached to or formed of a bent or coiled piece of spring steel attached directly to the upper surface 66 of mailbox 12 without the use of a toggle bolt wing. The spring steel would provide the pivotal action and spring force necessary to raise the stem 18 following opening of the mailbox door 74. Also, it is contemplated that the stem 118 may be formed of plastic and have embedded therein a spring or piece of spring steel.

With reference again to FIG. 1 of the drawings, without tab 120 located under flange 78 of door 74, the torsion spring 24 of toggle bolt wing 14 forces the stem upwardly to its raised substantially vertical position. In use, a person opens door 74, inserts outgoing mail into the mailbox housing 60 through forward opening 72. Next, the user simply grasps upper stem section 116 and pulls the stem 18 forwardly and downwardly until the upper stem section 116 is located adjacent the upper surface of the mailbox with the tab 120 positioned to be received under the lip or flange 78 of closed door 74. Lastly, the user closes the door 74 and thereby releasably locks the stem 18 in its lowered set position (FIG. 2) and raises the flag 92 of the outgoing mail signal 90.

If the mail delivery person picks up the outgoing mail and has no incoming mail to place in the mailbox 12, they will be instructed to place the stem 18 in its lowered set position (FIG. 2) with tab 120 located under flange 78 with the mailbox door 74 in its closed position (FIG. 2). This will indicate to the homeowner or mailbox owner that no incoming mail has been delivered into the mailbox 12.

If, however, there is incoming mail which the mail person has delivered into the mailbox, the mail person will be instructed to leave the stem 18 in its raised mail delivered indicating position (FIG. 1).

Instructions to the mail person on how to operate the mail delivered indicator 10 can be attached to the inner surface of panel 76 of mailbox door 74. Thus, if a substitute or new delivery person delivers mail to mailbox 12 or simply picks up outgoing mail therefrom, they will know how to operate the device 10.

Typically, a conscientious mail carrier or mail delivery person will lower outgoing mail signal flag 92 when they have picked up outgoing mail from the interior of mailbox 12. Thus, an instruction for the mail carrier or delivery person may read as follows:

(1) Please lower the red flag if you pick up outgoing mail.

(2) Please set the horse in its lowered position if you have not delivered any incoming mail.

(3) Please leave the horse in its raised mail delivered indicating position if you have delivered incoming mail.

Thank You!

If the mail person or carrier follows these simple instructions, then the mailbox owner or homeowner, business owner, or the like will know when outgoing mail has been picked up, when incoming mail has been delivered and when incoming mail has not been delivered. Once, the mail delivered indicator apparatus and method of the present invention becomes known through widespread use of the device and method, it may not be necessary to instruct the mail carrier or mail delivery person on how to operate the device 10.

Although the silhouette horse design element 118 of stem 18 is aesthetically pleasing, it is contemplated that alternative design elements may be incorporated into the stem of the mail delivered indicator apparatus of the present invention. As shown in FIGS. 4–13 of the drawings, other design elements may be used and selected by the mailbox owner or user to satisfy their personal taste, name, business, favorite hobby or activity, or the like.

Figure 4:
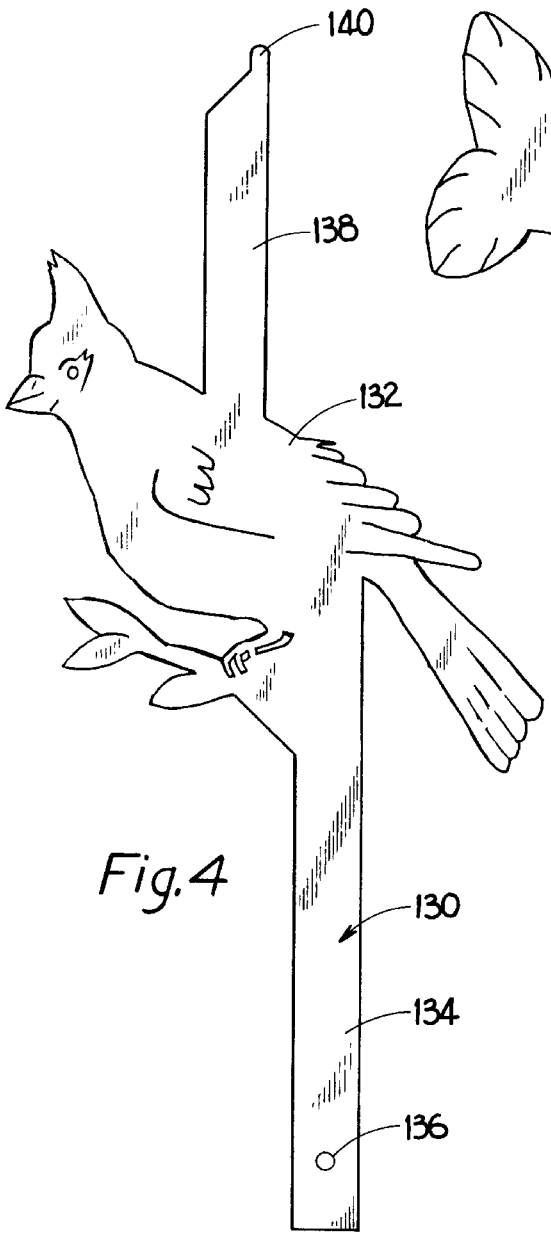
FIGS. 4–9 are schematic front view representations of alternative stems having design elements integral therewith.

As shown in FIG. 4 of the drawings, a preferably reversible stem 130 has a cardinal or bird design 132, a lower stem section 134, an attachment opening 136, an upper section 138, and a tab 140. The stem 130 is shown reversed from that of stem 18 of FIGS. 1–3, in that the offset of upper stem section 138 with respect to lower stem section 134 is to the left. However, by simply flipping stem 130 over, the offset would be to the right.

Figure 5:
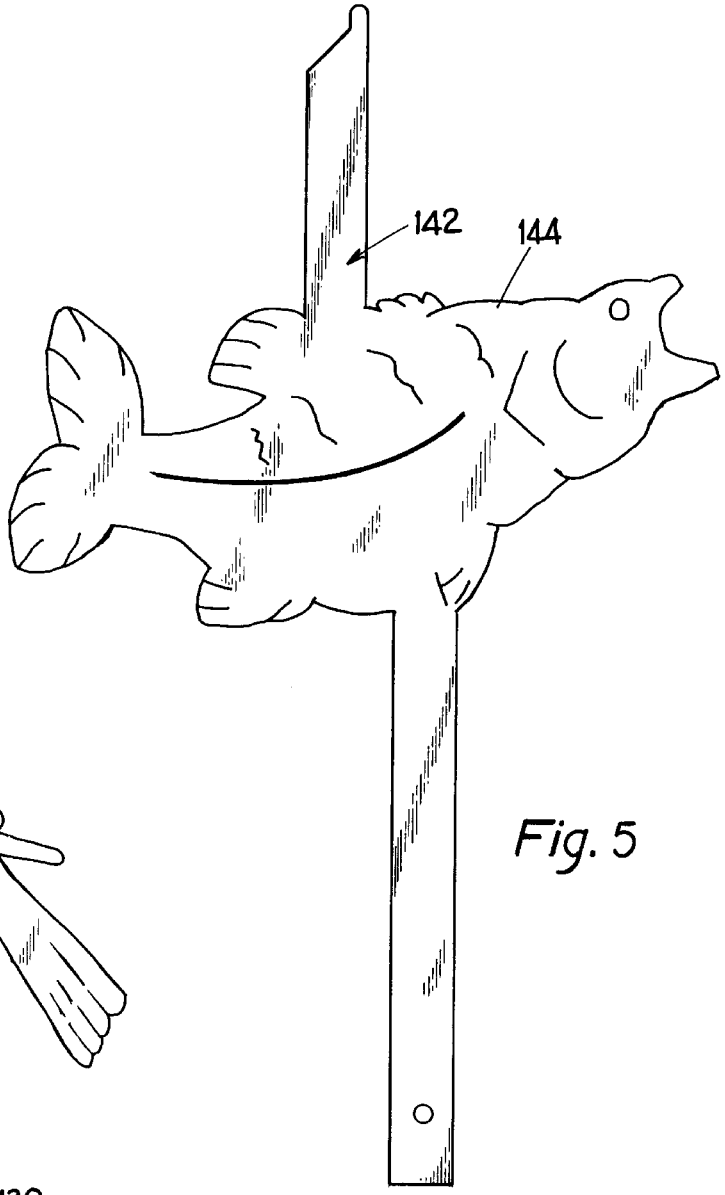

As shown in FIG. 5 of the drawings, a stem 142 includes a bass or fish design element 144.

Figure 6:
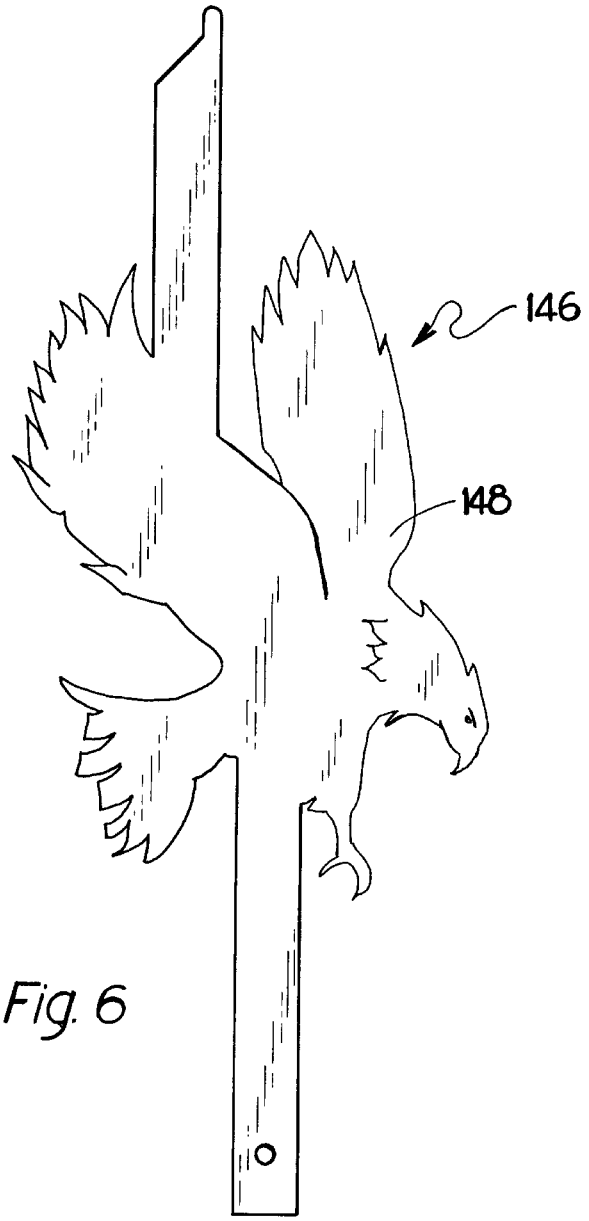

FIG. 6 shows a stem 146 having a profile or silhouette design element 148 representing an eagle or other bird of prey.

Figure 7:
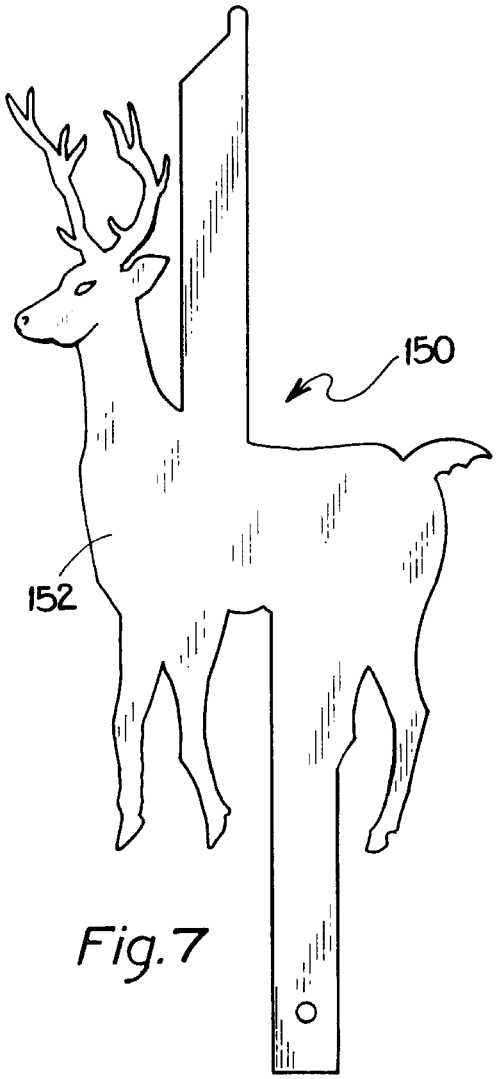

FIG. 7 shows a stem 150 having a design element 152 representing the profile or silhouette of a deer, elk, or the like.

Figure 8:
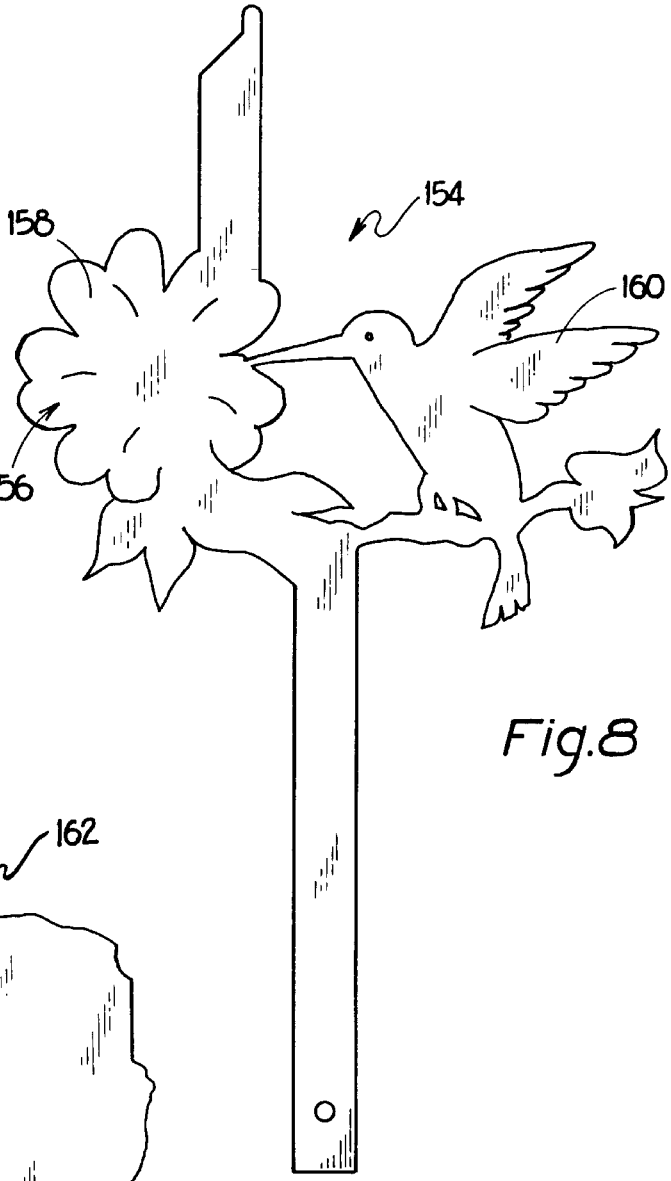

FIG. 8 shows a stem 154 having a multi-part design element 156 including a flower 158 and a hummingbird 160.

Figure 9:
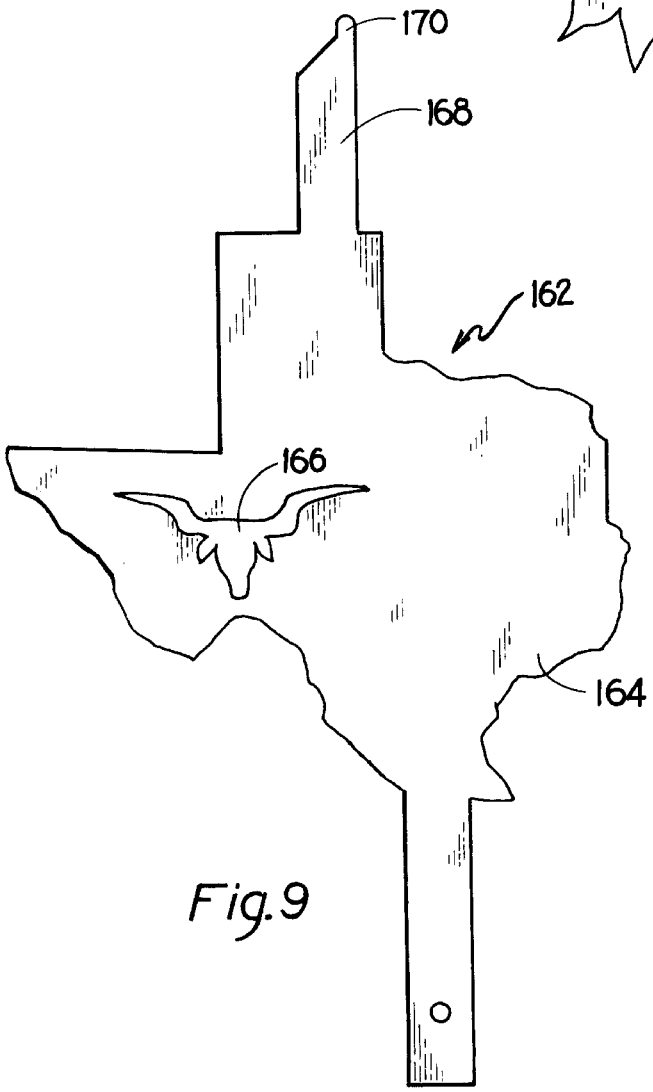

FIG. 9 shows a stem 162 including a design element 164 representing the profile or silhouette of the State of Texas and having an opening 166 cut therein and representing a longhorn steer, or the like. An upper stem section 168 differs from the other upper stem sections in that it does not include a tab but instead has an angled rounded upper end 170. Although it is not required for the upper end of the upper stem section to have a reduced size tab or angle, use of a tab or angled upper end facilitates the insertion of the upper stem section under the lip of the mailbox door.

FIGS. 1–9 of the drawings, illustrate or represent stems having integral lower stem sections, design elements and upper stem sections. Such stems are relatively easy and inexpensive to manufacture, easy to utilize, sturdy, aesthetically pleasing, reversible, and may take on many sizes and shapes not heretofore known in the mail delivered indicator arts.

As contrasted to FIGS. 1–9 of the drawings, FIGS. 10–13 are directed to design elements which are attachable to a mailbox mail delivered indicator mast or stem. Also, the attachable design elements are themselves preferably reversible to accommodate, for example, placement of the design element on an offset stem with either a right or left hand offset.

Figure 10:
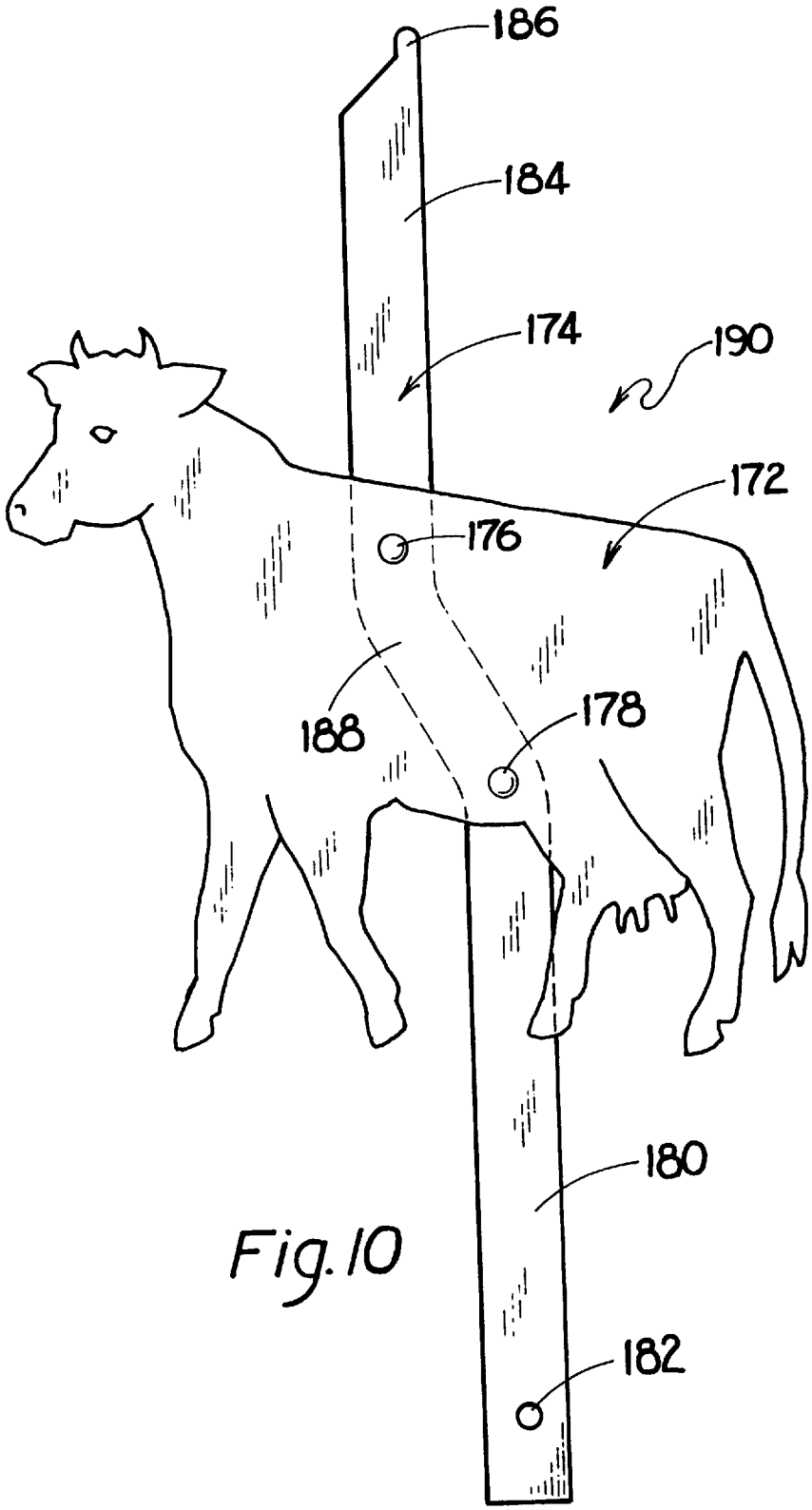
FIG. 10 is a schematic front view illustration of an elongate offset stem having a separate design element attached thereto.

More particularly, as shown in FIG. 10 of the drawings, an attachable design element 172 representing the profile or silhouette of a cow such as a milk cow or guernsey is attached to an offset stem 174 by rivets or fasteners 176 and 178. Stem 174 includes a lower stem section 180 having an attachment opening 182, an upper stem section 184 having a tab 186 at the upper end thereof, and an offset or dogleg 188 joining the upper and lower stem sections 180 and 184. The rivets or fasteners 176 and 178 are received in respective circular openings in the design element 172 and stem 174. Both the design element 172 and stem 174 are preferably reversible. A stem assembly 190 including the design element 172, stem 174, and rivets 176 and 178 is shown with a left hand offset. By simply flipping the stem assembly over or rotating it through 180°, it would have a right hand offset but the stem 174 would be in front of design element 172. However, if the design element 172 is rotated through 180° prior to rotation of the stem 174 through 180° and attachment of the design element to the stem, then the stem can be located behind the design element and provide a right hand offset.

Although the design element 172 is attached to stem 174 by rivets or fasteners 176 and 178, it is contemplated that depending on the material of which the design element and stem are constructed, they may be permanently or releasably affixed one to the other by arc welding, glues, solvents, rivets, screws, one direction threaded fasteners, locknuts, or the like. Further, it is to be understood that the design element 172 and stem 174 may be formed of any sturdy, relatively rigid material such as stainless steel, aluminum, plastic, and the like. Still further, it should be understood that since the design element 172 is attachable to the stem 174, the design element 172 need not be flexible and may be formed of more rigid materials than that used for the unitary or integral stems of FIGS. 1–9. Some flexibility in the upper stem section 184 facilitates the placement of the tab 186 under the lip or flange of the mailbox door.

Figure 11:
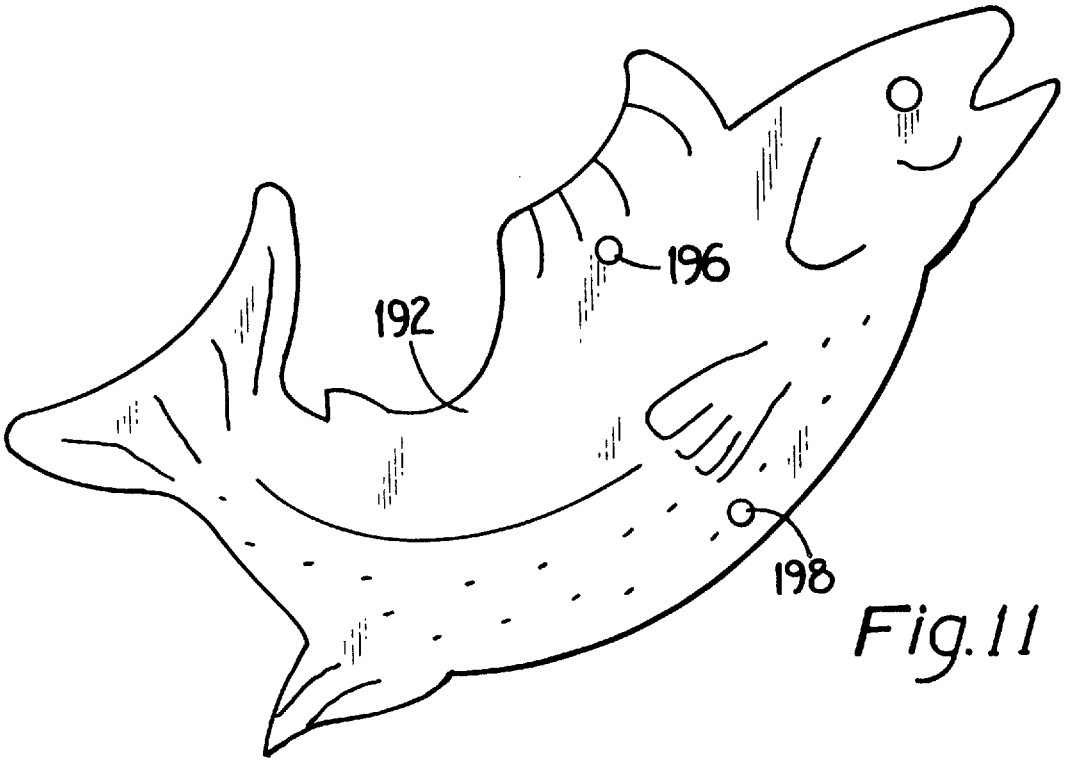
FIGS. 11 and 12 are schematic front view representations of attachable design elements.
Figure 12:
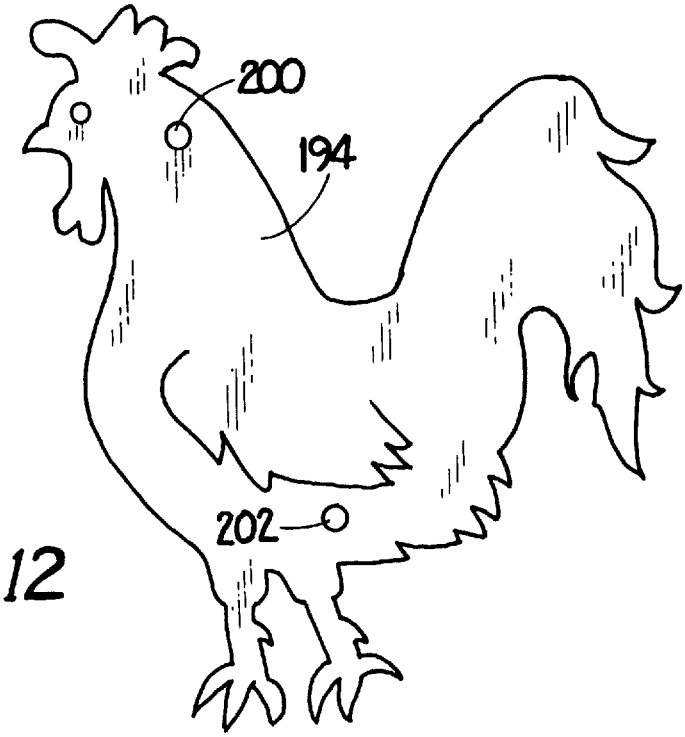

FIGS. 11 and 12 of the drawings depict preferably reversible, attachable design elements 192 and 194 representing respectively a trout and a rooster. Design element 192 includes upper and lower circular openings 196 and 198 to provide for attachment of the design element 192 to an offset or non-offset or straight stem or mast. Although it is preferred to use an offset stem in the mail delivered indicator of the present invention, a non-offset stem or mast can be used with a mailbox which does not include a conventional door latch, or can be used with a mailbox including a conventional door latch and accommodating the door latch by angling the toggle bolt wing, locating the toggle bolt wing offset with respect to the top center of the mailbox, or locating the toggle bolt wing on the side of the mailbox. Similarly, the design element 194 includes upper and lower circular openings 200 and 202 to facilitate attachment to a stem or mast.

Figure 13:
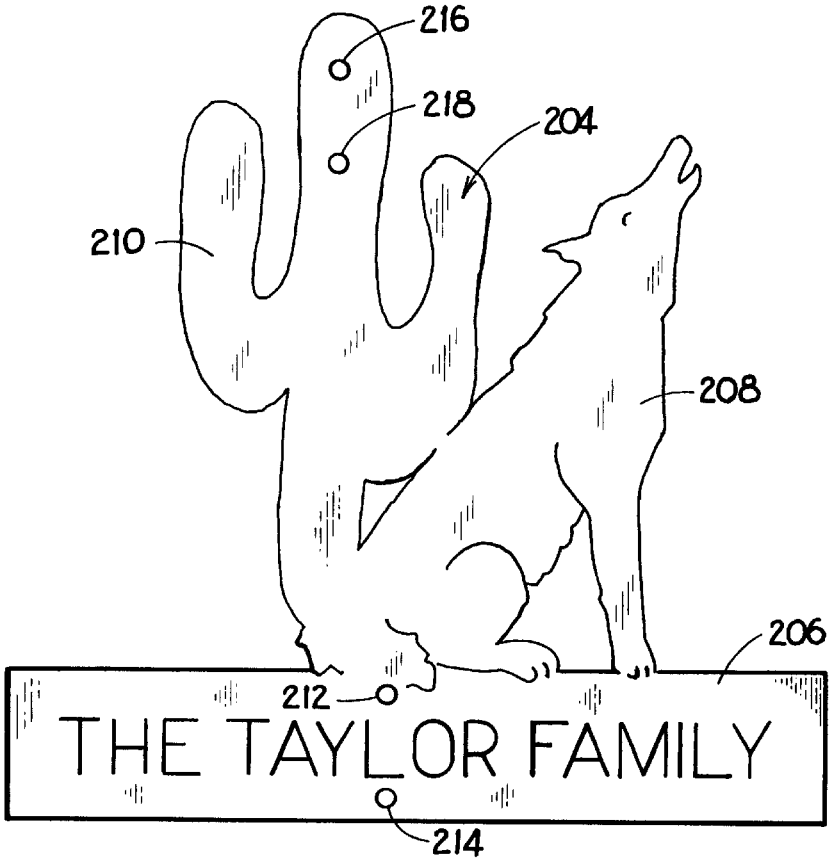
FIG. 13 is a schematic front view illustration of an alternative attachable element including a design together with a name plate.

With respect to FIG. 13 of the drawings, an attachable multiple component design element 204 includes a rectangular name plate 206 and profiles or silhouettes 208 and 210 representing respectively a howling coyote and a saguaro cactus. The name plate 206 is adapted to portray a family name, name and address, address, box number, business name, team name, logo, and the like and includes upper and lower circular openings 212 and 214 for attachment to a stem or mast. Likewise, the saguaro cactus silhouette includes upper and lower circular openings 216 and 218 for attachment to a stem or mast. The circular openings in the saguaro cactus and name plate are offset from one another to accommodate the use of an offset stem.

Although the design element 204 is shown as an integral or combined unit which may be attached to a non-offset stem or mast by either the openings 216 and 218 or 212 and 214, it is contemplated that the name plate may be separate therefrom and used together with or without a profile or silhouette design element representing an animal, object, mascot, state, sport, activity, hobby, mode of transportation, vehicle, association, or the like.

It is preferred that the attachable design elements of FIGS. 10–13 of the drawings, be constructed of a sturdy, non-corrosive, fairly rigid material such as about 10–40, preferably 19–22 gauge painted or coated steel, stainless steel, zinc, chrome, brass, or gold-tone plated steel, aluminum, or plastic such as polyvinylchloride (PVC). The attachable design element need not be formed of the same material as the stem or mast to which it is attached. Further, it may be attached to the stem by pop rivets, screws, nuts and bolts, welding, arc welding, glues, solvents, or the like depending on the material of the design element and the stem.

As shown in FIG. 16 of the drawings, a mailbox and mail delivered indicator combination generally designated 220 includes a mail delivered indicator 222 attached to the side of a mailbox 224. The mailbox 224 is of identical conventional construction to that of the mailbox 12 of FIGS. 1–3 of the drawings with the exception of the addition of a name or address plate 226 to the upper surface 228 of the mailbox. Like the mailbox 12, the mailbox 224 includes a mailbox latch 230, a door 232, and a left side wall 234.

The mail indicator device 222 is of identical construction to the device 10 of FIGS. 1–3 of the drawings except that the stem has been reversed to provide a left hand offset. The device 222 includes a toggle bolt wing or hinge mechanism 236, a 90-degree stop 238, and a stem 240. The stem 240 includes a lower stem section 242, a design element 244, an upper stem section 246, and a tab 248.

The mail delivered indicator 222 is mounted to the left hand side of the mailbox 224 to accommodate the address or name plate 226. An L-bracket 250 and a hook-shaped catch 252 together form an attachment assembly. The L-bracket 250 includes a vertical member 254 attached to the left side wall 234 of mailbox 224 by threaded fasteners 256 and a horizontal member 258 to which the hinge mechanism or toggle bolt wing 236 is attached by, for example, threaded fasteners. In accordance with the exemplary embodiment shown, the outer edge of the horizontal member 258 is rounded for safety and aesthetics.

The hook-shaped catch 252 has a vertical member 260 attached to the mailbox door 232 by threaded fasteners 262 and a horizontal member 264 having a downturned end 266 which serve as a catch for tab 248 of stem 240. The L-side bracket 250 and hook-shaped catch 260 can be used to mount the mail delivered indicator 222 to either the right or left hand side of the mailbox depending upon which side of the mailbox the outgoing mail signal or flag is located. As shown in FIG. 16 of the drawings, the catch 252 includes an outward bend to accommodate a raised edge of the mailbox door 232. The catch for mounting the indicator device 222 to the right side of the mailbox would include an opposite bend for accommodating the edge on the mailbox door. For mailboxes which do not include a raised edge, the catch 242 need not include such a bend and may be used for either a left or right hand mount by simply rotating the catch through 180°.

In accordance with a particular example of the present invention, the side mount bracket 250 and catch 252 are formed of a sturdy corrosion resistant metal or plastic material such as stainless steel, zinc, chrome or other plated metal, plastics such as polyvinylchloride and include respective circular openings for receiving the threaded fasteners 256, 262 and the like therethrough.

In accordance with a particular example of the present invention, the L-shaped bracket 250 has a width of about 2¾ inches, a vertical member height of about 4½ inches, a horizontal member length of 1¾ inches, a 90° bend, and respective pairs of circular openings for receiving 8–32×⅜ inch screws therethrough. Also in accordance with this example, the catch 252 has vertical member dimensions of a height of about 5 inches, a width of about ½ inch, a horizontal member dimension of length of about 3 inches, and a height of about ¼ inch and a thickness of about ⅛ inch.

The side mount bracket and catch 250 and 252 and the mail delivered indicator device 222 can be formed of a variety of materials and have various colors, may be painted red, white, black, and the like to provide a monochrome appearance to the mailbox and indicator combination 220, or the mailbox side mount bracket, side mount catch, indicator device or its components can be of different colors or materials to provide a personalized aesthetic pleasing, decorative appearance.

Figure 15:
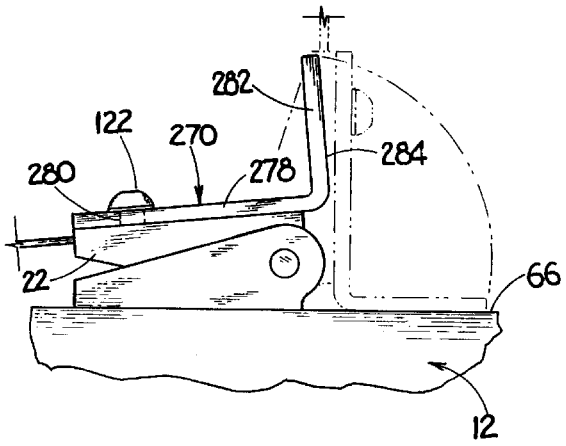
FIG. 15 is a fragmentary side view representation of another 90 degree stop element in accordance with another embodiment of the present invention; and, FIG. 16 is a perspective view representation of a mail delivered indicator apparatus of the present invention mounted to one side of a conventional mailbox including a elongate name or address plate along the upper surface thereof using a mounting bracket attached to the side of the mailbox and a catch attached to the front surface of the mailbox door.

As shown in FIGS. 14 and 15 of the drawings, the 90° stop element 16 of the device 10 has been replaced with a L-shaped stop member 268 and 270 respectively. The L-shaped stop member 268 of FIG. 14, has a horizontal portion 272 including a pair of circular openings 274 for receiving the threaded shafts of fasteners 100 therethrough. Further, the L-shaped stop member 268 includes a vertical portion 276 which serves as a stop or abutment surface for preventing further movement of the toggle wing side piece 22 once it has reached a substantially vertical position.

The L-shaped stop member 270 of FIG. 15 includes a first leg 278 having a circular opening 280 for receiving the threaded shaft 124 of fastener 122 therethrough. Further, the member 270 includes a second leg 282 at 90° with respect to the first leg and serving as a stop or abutment surface for contacting the upper surface 66 of mailbox 12 and preventing further movement of the toggle wing side piece 22 once it has reached a substantially vertical or 90° raised position.

In accordance with a particular example of the present invention, the L-shaped stop members 268 and 270 are formed of 3/16 inch thick, ½ inch wide steel stock having a 900 bend therein and circular openings dimensioned to receive 8–32×⅜ inch screws therethrough. To prevent damage to the upper surface 66 of the mailbox 12, an outer surface 284 of second leg 282 may be covered with a scratch preventing material such as tape, plastic, or the like.

Although it is preferred to mount the mail delivered indicator device to the upper surface of a mailbox as shown in FIGS. 1–3 of the drawings, it is contemplated that for a particular arrangement of mailboxes or a particular mailbox location one may prefer to mount the indicator to the right or left hand side of the mailbox so that the indicator does not extend vertically but instead extends out horizontally to provide an indication that mail has been delivered. This is easily accomplished by merely attaching the hinge mechanism 14 to the side of the mailbox in position so that the tab 120 at the end of the stem 18 will be located under the lip of the mailbox door.

In accordance with one aspect of the present invention, the mail delivered indicator 10 or 222 of FIGS. 1–3 and 14–16 of the drawings may be sold as a kit for after-market placement of the mail delivered indicator device or apparatus on a conventional mailbox. In accordance with one example, the kit includes the hinge mechanism 14, the 90° stop 16, the stem 18, and threaded fasteners. In accordance with a second example, the kit is a base kit and includes only the hinge mechanism 14, 90° stop 16, and fasteners 100 and 122. In accordance with the second example, the stems 18 would be sold separately with or without a threaded fastener 122. In accordance with a third example, attachable design elements would be sold separately from offset or non-offset stems and threaded fasteners. In accordance with a fourth example of the present invention, a side mount kit would include side mount bracket 250, catch 252 and threaded fasteners 256 and 262 for attaching the side mount bracket and catch to a mailbox.

Thus, it will be appreciated that as a result of the present invention, a highly effective improved mail delivered indicator apparatus and method is provided by which the principal objective, among others, is completely fulfilled. It is contemplated, and will be apparent to those skilled in the art from the preceding description and accompanying drawings, that modifications and/or changes may be made in the illustrated embodiments without departure from the present invention. Accordingly, it is expressly intended that the foregoing description and accompanying drawings are illustrative of preferred embodiments only, not limiting, and that the true spirit and scope of the present invention be determined by reference to the appended claims.

What is claimed is:

1. A mail delivered indicator apparatus for use with a conventional mailbox having a door attached to a forward open end thereof and with the door having a short, rearwardly extending flange adapted to cover the forward open end and being mounted for pivotal movement about a bottom edge thereof from open to closed positions of the mailbox, comprising: a toggle bolt wing including first and second side pieces, a nut, and a torsion spring, a vertical stop element attached to said toggle bolt wing, and a planar stem having a first end thereof attached to one of said first and second side pieces and a second end thereof adapted to be located under the flange of the door when the door is in its closed position.

2. The apparatus as recited in claim 1 wherein the vertical stop element comprises a short threaded member received in a threaded opening in the nut in said toggle bolt wing and extending sufficiently outwardly from said toggle bolt wing to limit upward movement of the stem to a substantially vertical position.

3. The apparatus as recited in claim 2 wherein said threaded member is a set screw and an end thereof extending from said toggle bolt wing is covered with a protective cap.

4. The apparatus as recited in claim 1 wherein said vertical stop element comprises an L-shape bracket having a first leg thereof adapted to be located between one of said first and second side pieces and an upper surface of the mailbox and a second leg thereof serving as an abutment surface for preventing movement of the other of said first or second side pieces from travel beyond a substantially vertical position.

5. The apparatus as recited in claim 1 wherein said vertical stop element comprises an L-shape bracket having a first leg thereof adapted to be attached to one of said first and second side pieces with a second leg thereof located to abut with an upper surface of the mailbox upon rotation of said one of said side pieces to a substantially vertical position.

6. The apparatus as recited in claim 1 wherein said stem includes a design element integral therewith.

7. The apparatus as recited in claim 1 wherein said stem includes an offset between the first and second ends thereof sufficient to accommodate a door latch on a conventional mailbox.

8. The apparatus as recited in claim 1 further comprising a design element attached between the first and second ends of said stem.

9. The apparatus as recited in claim 1 wherein said stem includes a design element integral therewith and an offset between upper and lower stem sections extending from the design element.

10. The apparatus as recited in claim 1, wherein the stem includes a reduced size tab extending from the second end thereof.

11. The apparatus as recited in claim 1 wherein said stem is reversible.

12. The apparatus as recited in claim 1 wherein said toggle bolt wing includes two torsion springs.

13. The apparatus as recited in claim 1 wherein said toggle bolt wing includes a torsion spring having a wire diameter of about 0.032 to 0.038 inches.

14. The apparatus as recited in claim 1, wherein said stem is formed of about 19 to 22 gauge steel.

15. The apparatus as recited in claim 1, wherein said stem includes an offset upper section with a length of at least about 2 inches.

16. The apparatus as recited in claim 15, wherein the second end of the stem includes a reduced size tab adapted to fit under the flange of the door.

17. In a mailbox including a door and an outgoing mail signal flag attached to one side thereof, the improvement comprising: a mail delivered indicator apparatus including a toggle bolt wing having first and second side pieces, a nut, and a torsion spring, a vertical stop element attached to said toggle bolt wing, and a planar stem having a first end attached to one of said first and second side pieces and a second end thereof adapted to be located under a flange of door when the door is in a closed position.

18. A mail delivered indicator and attachment apparatus, comprising: a mail delivered indicator including a toggle bolt wing having first and second side pieces, a nut, and a torsion spring, a vertical stop element attached to the toggle bolt wing, and a planar stem having a first end attached to one of the first and second side pieces and a second end thereof adapted to be located under a flange of a door of a mailbox when the door is in its closed position, and an L-shape bracket adapted to be attached to the side of the mailbox for mounting the toggle bolt wing from a side of the mailbox and a hook-shaped catch adapted to be attached to a front surface of the door of the mailbox for releasably securing the second end of the stem to a side of the door of the mailbox.

19. A mail delivered indicator kit for use with a conventional mailbox comprising: a mail delivered indicator apparatus including a toggle bolt wing having first and second side pieces, a nut, and a torsion spring, a vertical stop element attached to said toggle bolt wing, and a planar stem having a first end attached to one of said first and second side pieces and a second end thereof adapted to be located under a flange of a mailbox door when the door is in its closed position, means for attaching one of the side pieces of the toggle bolt wing to an exterior surface of the mailbox, and means for attaching the stem to the other one of the side pieces of the toggle bolt wing.

20. A mail delivered indicator base kit for use with a conventional mailbox comprising: a toggle bolt wing having first and second side pieces, a nut, and a torsion spring, a vertical stop element adapted to be attached to said toggle bolt wing, means for attaching one of the side pieces of the toggle bolt wing to an exterior surface of the mailbox, and means for attaching a stem to the other one of the side pieces of the toggle bolt wing.

* * * * *